United States Patent [19]

Greenway et al.

[11] Patent Number: 4,991,264

[45] Date of Patent: Feb. 12, 1991

[54] APPARATUS AND METHOD FOR USE IN-LINE WITH A CARD TO ENHANCE TENSILE STRENGTH IN NONWOVEN MATERIALS

[75] Inventors: John M. Greenway, Westwood, Mass.; Robert F. Hammann, North Smithfield, R.I.

[73] Assignee: International Paper Company, Purchase, N.Y.

[21] Appl. No.: 466,088

[22] Filed: Jan. 16, 1990

[51] Int. Cl.[5] ..... D04H 1/70

[52] U.S. Cl. ..... 19/296; 28/103

[58] Field of Search ..... 19/296; 28/103

[56] References Cited

U.S. PATENT DOCUMENTS

| | | | |
|---|---|---|---|
| 411,207 | 9/1889 | Symons . | |
| 1,989,435 | 1/1935 | Wallquist . | |
| 2,720,005 | 10/1955 | Clark et al. | 19/296 |
| 2,788,547 | 4/1957 | Kaufman et al. . | |
| 3,066,358 | 12/1962 | Schiess . | |
| 3,422,510 | 1/1969 | Livingston et al. . | |
| 3,493,452 | 2/1970 | Cole | 19/296 |
| 3,747,161 | 7/1973 | Kalwaites | 28/103 |
| 3,768,118 | 10/1973 | Ruffo et al. . | |
| 3,792,509 | 2/1974 | Morikawa et al. . | |
| 3,854,917 | 12/1974 | McKinney et al. . | |
| 3,900,921 | 8/1975 | Zafiroglu . | |
| 4,089,086 | 5/1978 | Contractor . | |
| 4,106,163 | 8/1978 | Deswerchére | 19/296 |
| 4,217,387 | 8/1980 | Viezee et al. | 28/103 |
| 4,489,462 | 12/1984 | Dodson, Jr. | 19/296 |
| 4,599,766 | 7/1986 | Wirth | 19/296 |
| 4,637,104 | 1/1987 | Mente | 19/296 |
| 4,688,301 | 8/1987 | Thorbjörnsson et al. | 19/296 |
| 4,697,311 | 10/1987 | Bernhardt et al. | 19/296 |
| 4,712,277 | 12/1987 | Gustavsson | 19/296 |

FOREIGN PATENT DOCUMENTS

| | | | |
|---|---|---|---|
| 592211 | 4/1989 | Italy | 19/155 |
| 940794 | 11/1963 | United Kingdom | 19/296 |

OTHER PUBLICATIONS

Ernst Fehrer, "The Random Carding Machine K-21", From Page 60, ATI Apr. 1987.

*Primary Examiner*—Werner H. Schroeder
*Assistant Examiner*—John J. Calvert
*Attorney, Agent, or Firm*—Francis J. Clark

[57] ABSTRACT

The cross direction tensile strength of a carded web is increased by 30% to 50%, without a decrease in machine direction tensile strength, by realigning the fibers of the carded web at least partially in the cross direction. In the preferred embodiment, an air blower manifold is arranged above a scrambler roll onto which a carded web is transferred from a doffer roll at the output end of a conventional card. The air blower manifold has a plurality of louvers spaced across the width of the web in the cross direction for realigning the fibers in the cross direction. The increase in cross directional tensile strength is obtained in the resulting bonded, hydroentangled, and other nonwoven fabrics.

20 Claims, 7 Drawing Sheets

APPARATUS AND METHOD FOR USE IN-LINE WITH A CARD TO ENHANCE TENSILE STRENGTH IN NONWOVEN MATERIALS

FIELD OF INVENTION

This invention generally relates to nonwoven materials and processes for their manufacture, and more particularly to an apparatus for use in-line with a conventional carding apparatus (equipped with a scrambler) to enhance nonwoven tensile strength characteristics.

BACKGROUND ART

Nonwoven fabrics are conventionally manufactured from webs of staple fibers which are provided, through various bonding techniques, with structural integrity and desired fabric characteristics. Dry-laid techniques in which nonwoven webs are mechanically, chemically and/or thermally bonded are among the most widely utilized processes for manufacturing nonwoven fabrics.

Conventional nonwoven process lines employ carding apparatus to process staple fibers for use in nonwoven fabrics. In the carding process staple fibers are opened, aligned, and formed into a continuous sliver or web free of impurities. An exemplary carding apparatus is illustrated in U.S. Pat. No. 3,768,118 to Ruffo et al.

The art has recognized that fiber orientation within nonwoven web materials employed in dry-laid processes correlates to physical properties in the bonded and processed nonwoven fabrics. Fibers in carded webs are characterized by machine direction ("MD") and cross-direction ("CD") web axes. MD and CD fiber orientations respectively refer to orientation in the process and cross directions on nonwoven process lines. The predominance of MD fiber orientation yields fabrics which have correspondingly enhanced MD and diminished CD tensile strength.

To provide uniform tensile strength characteristics in nonwoven fabrics, the art has introduced techniques which randomize the fibers in the web prior to bonding. For example, it is known in the art to employ airlay systems to randomize carded web materials. Such systems typically include disperser mechanisms which disperse fibers from a mat composed of fibers into a turbulent air stream for randomization and collection on web forming screens. Such apparatus have proved satisfactory in producing randomized web materials, however, this approach requires mechanically complex apparatus which is quite expensive and can be limited in width and speed. Exemplary airlay systems are shown in U.S. Pat. Nos. 3,900,921 to Zafiroglu and 4,089,086 to Contractor et al.

Another approach of the art is shown in U.S. Pat. No. 3,066,358 to H. H. Schiess in which web fiber orientation is modified through adjustment of the angle of interface between a card cylinder and doffing belt in a conventional card. The card cylinder is positioned to rotate in a plane which is angularly offset from the machine direction of the card line and doffing belt to impart cross-directional mechanical movement of the web fibers and enhanced fiber randomization. This approach requires use of complex apparatus and retooling of conventional process lines.

From the foregoing it will be appreciated that the art has long recognized a need to enhance CD tensile strengths in nonwoven webs but has not proposed an entirely satisfactory means of achieving this objective. There is need in the art for an apparatus and process which can be integrated with conventional nonwoven production lines without requirement of extensive and costly retooling.

Accordingly, it is a broad object of the invention to provide an apparatus for enhancing fiber uniformity and CD tensile strength in carded nonwoven webs which is of simple design, can be integrated with conventional nonwoven production lines, and is adaptable to accommodate the different widths and configurations of such conventional nonwoven production lines.

A more specific object of the invention is to provide an apparatus and process for realigning fibers in carded nonwoven webs which obtain improved production line efficiencies and process speeds.

Another object of the invention is to produce carded nonwoven webs having tensile strength characteristics which are improved over the prior art scrambler webs.

SUMMARY OF THE INVENTION

According to the present invention, these purposes, as well as others which will be apparent, are achieved generally by providing an apparatus and related method for realigning the fibers of a nonwoven web from a conventional processing line by the application of a controlled, cross-directionally oriented air flow across the fibers of the carded web in order to enhance the CD tensile strength of the web. Surprisingly, this result is obtained without an associated reduction in MD tensile strength of the web. The realignment apparatus is positioned in spaced relation to the web supported at the output end of a carding apparatus, specifically a scrambling roll or a wired takeoff roll on which the fibers are held with a portion thereof standing erect. The realignment apparatus includes a manifold having output louvers which direct a uniform air flow across the web in order to cause realignment of the web fibers in the cross-direction.

The process line speed, air velocity, output louver configuration and spacing of the realignment apparatus from the web are selected to impart optimum energy to the web for fiber realignment. Uniform fiber distribution in the web is maintained by impacting the web with a substantially constant energy flux which is sufficient to reorient the fibers without displacing the arrangement of the web on the line support.

A preferred embodiment of the apparatus includes a manifold with a generally planar bottom panel having a plurality of spaced louvers arranged in the cross-direction across the width of the apparatus. The louvers have dimensions of approximately 0.01"×0.3" wide and have a center spacing between louvers of approximately one half inch. Further advantage can be obtained by angularly offsetting the louvers so that they are oriented at an upstream angle of approximately 20° to the cross direction.

Preferred process parameters for the practice of the invention include a web speed of about 375 ft/min., and cross air flow at the tops of the fibers of about 2500 ft/min. Nonwoven fabrics made from realigned carded webs in accordance with the invention include 18 gm./sq.yd thermal bond fabric of staple polypropylene fibers having a CD strip tensile strength of 406 grams/inch or more, and 41 gm./sq.yd. hydroentangled fabric of staple polyester and rayon fibers having a CD grab tensile strength of 8.0 lbs/inch without a decrease in MD tensile strength.

Further objects, features and advantages of the present invention will be apparent from the following detailed description of the preferred embodiments of the invention, considered in conjunction with the drawings, which should be construed in an illustrative and not limiting sense, as follows:

BEST MODE FOR CARRYING OUT THE INVENTION

Figure 1:
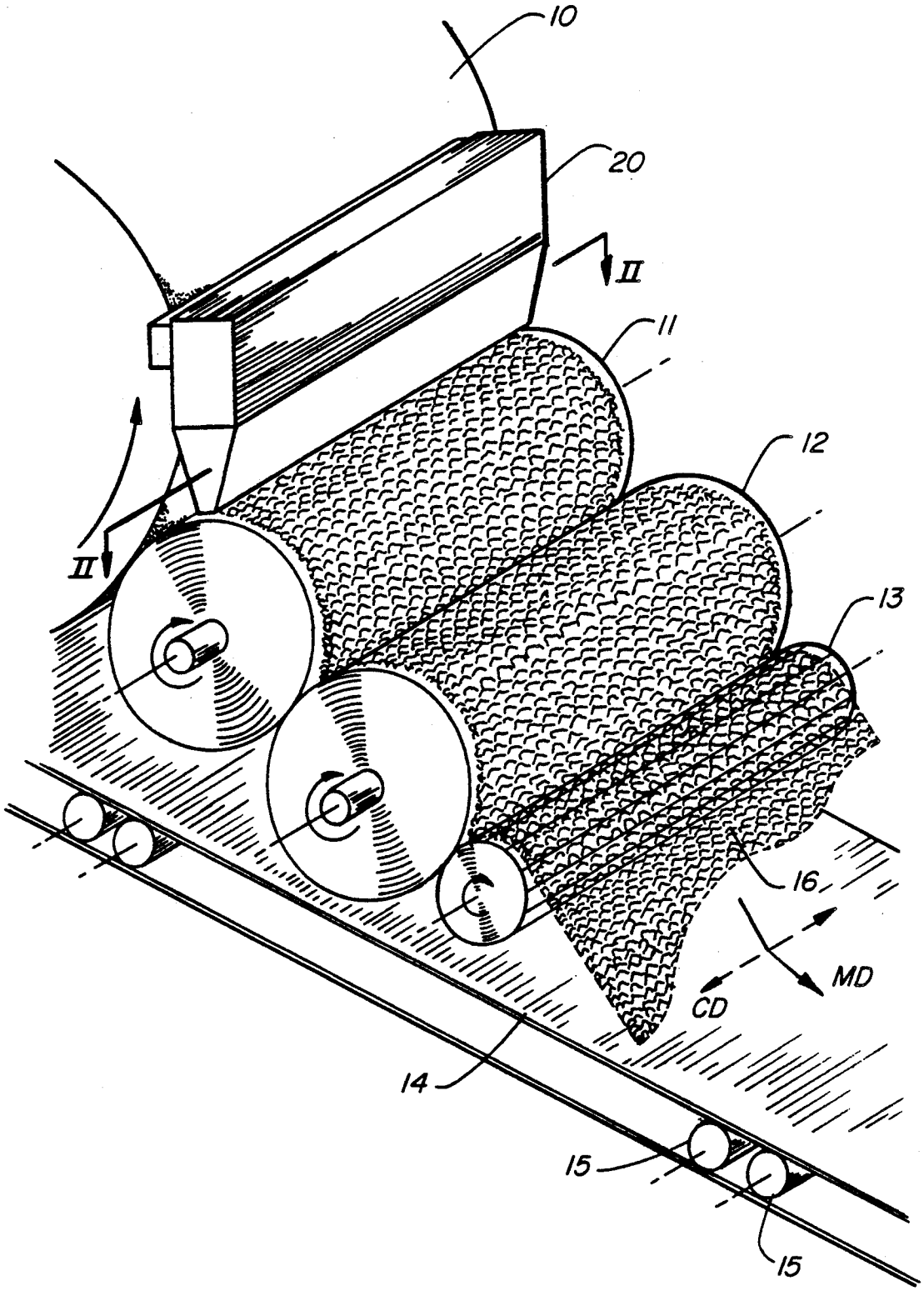
FIG. 1 is a perspective view of a directed fiber lay apparatus of the invention shown in-line with a conventional carding apparatus for processing a nonwoven web.

Referring to FIG. 1 a method and apparatus for carrying out the invention is illustrated at the output end of a conventional carding apparatus which is used to open and separate the fibers of a fiber mat or stock and form a carded web of the separated fibers. Typically, the output end of a carding apparatus includes a doffer roll 10 which carries the separated fibers in a web around a portion of its circumference, a scrambler roll 11 to which the oncoming web of fibers from the doffer roll 10 are transferred and randomized to a limited extent, a transfer roll 12 for taking the web of fibers off the scrambler roll 11, and a fluted takeoff roll 13 for laying the web in a smooth transition onto a moving belt or screen 14, driven on rollers 15, which carries the carded web 16 of fibers downstream for further processing. The scrambler roll 11 is clothed in carding wire on its outer circumference for holding the fibers thereon. The direction of the web in the direction of processing is referred to as the machine direction (MD). In conventional carding apparatus, the fibers in the web are oriented substantially in the machine direction when the web is output onto the transporting belt 14.

In accordance with the invention, an air blower manifold 20 is arranged at one circumferential position above the scrambler roll 11 extending in the direction across the width of the fiber web, referred to as the cross direction (CD). The manifold 20 has a plurality of air output elements arranged across the width of the web in the cross direction for realigning the fibers to have an orientation at least partially in the cross direction. This is found to substantially increase the cross directional tensile strength of the output web and the resultant nonwoven fabric produced therefrom.

Figure 2:
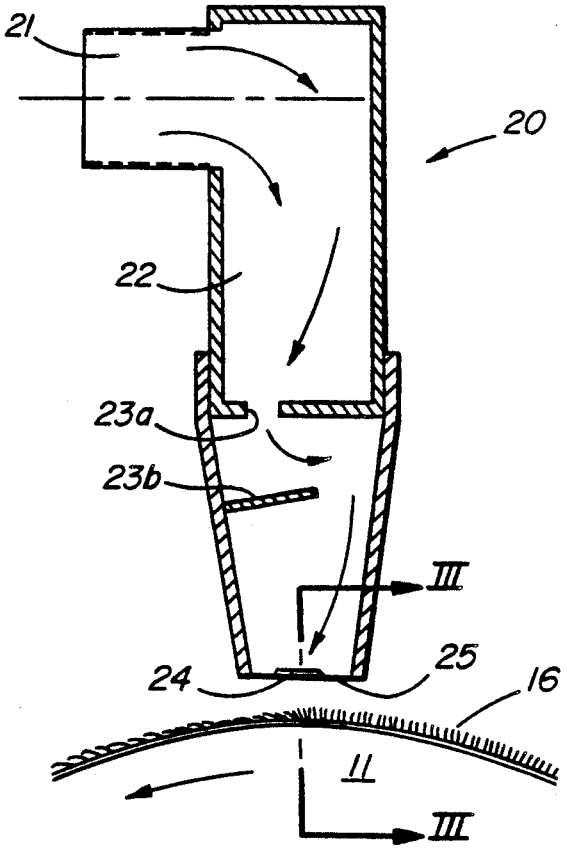
FIG. 2 is an enlarged side sectional view of the directed fiber lay apparatus taken along the line II—II of FIG. 1, the apparatus including an air manifold and output louvers positioned in spaced relation to a scrambler roll of the carding apparatus.

In FIG. 2, the air blower manifold 20 is shown in side sectional view having an inlet port 21, a plenum chamber 22, a wall **23*a* having holes therethrough and baffles 23*b* for producing 30 an even air flow distribution, and louvers 24 formed in a row in a bottom wall 25 of the manifold 20. The holes in the wall 23*a*, for example, have a diameter of ⅜ inch and are spaced at one inch intervals. The bottom end of the manifold 20 is shown facing downward perpendicularly to the circumference of the scrambler roll 11. The fibers of the web are carried on the scrambler roll 11 with at least a part thereof standing upright. The upright part of the fibers are blown sidewards in the cross direction by the air from the louvers 24 of the manifold 20**.

Figure 3:
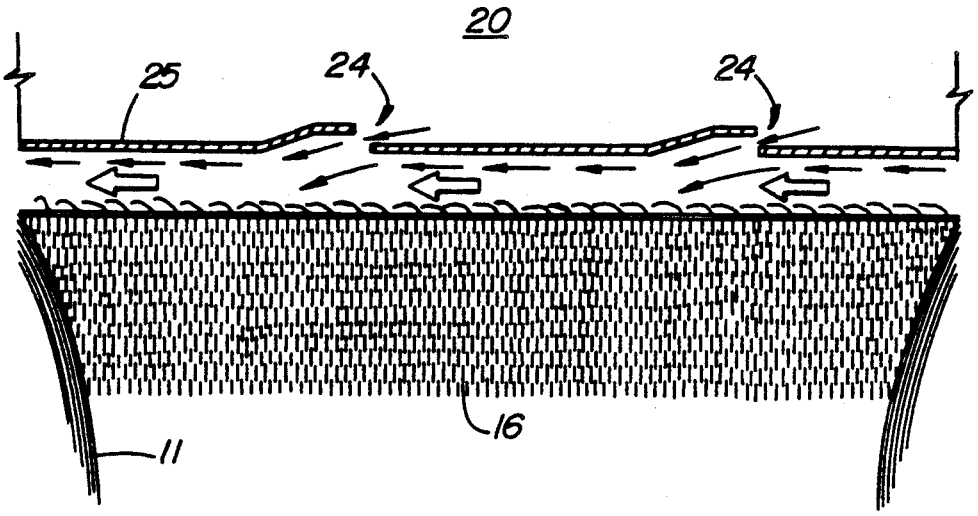
FIG. 3 is a front sectional view of the apparatus in FIG. 2, taken along the line III—III, showing the manner in which an air stream is directed from the manifold louvers across the nonwoven web on the scrambler roll to effect fiber realignment.

In FIG. 3, one version of the manifold 20 is shown in front sectional view (along view line A—A in FIG. 2). In this version, the output elements 24 are formed as louvers or slots pressed outwardly from a bottom wall 25 of the manifold 20. Air in the plenum chamber 22 of the manifold 20 is directed sidewards from the louvers 24 to blow the upright ends of the fibers on the scrambler roll 11 sidewards in the cross direction across the width of the web 16. Air introduced from the louvers combines into a uniform flow across the width of the scrambler roll and realigns the fibers from the machine direction towards the cross direction. In this version, the cross air flow from the louver elements is deflected around the next louver element slightly towards the web.

Figure 4:
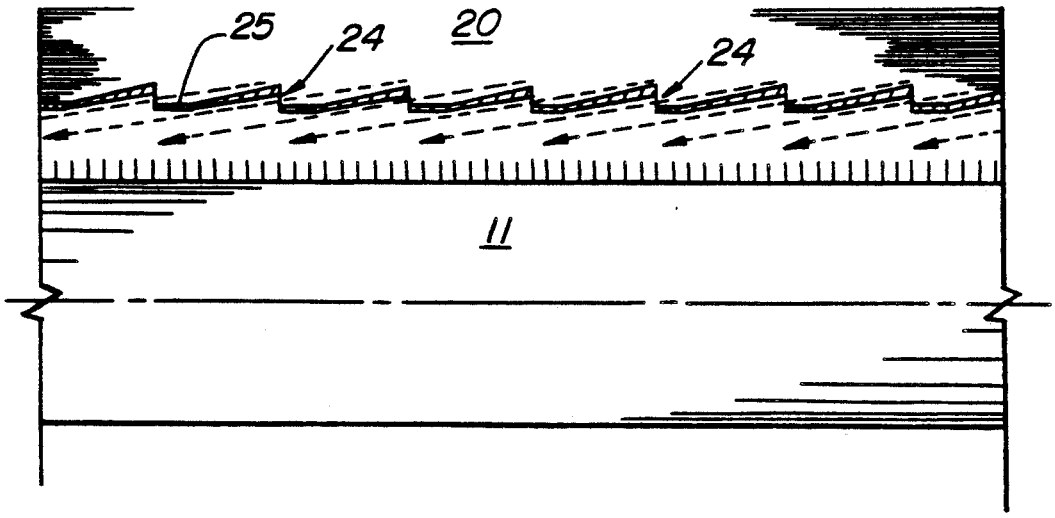
FIG. 4 is a front sectional view of another version of the manifold louvers.
Figure 6:
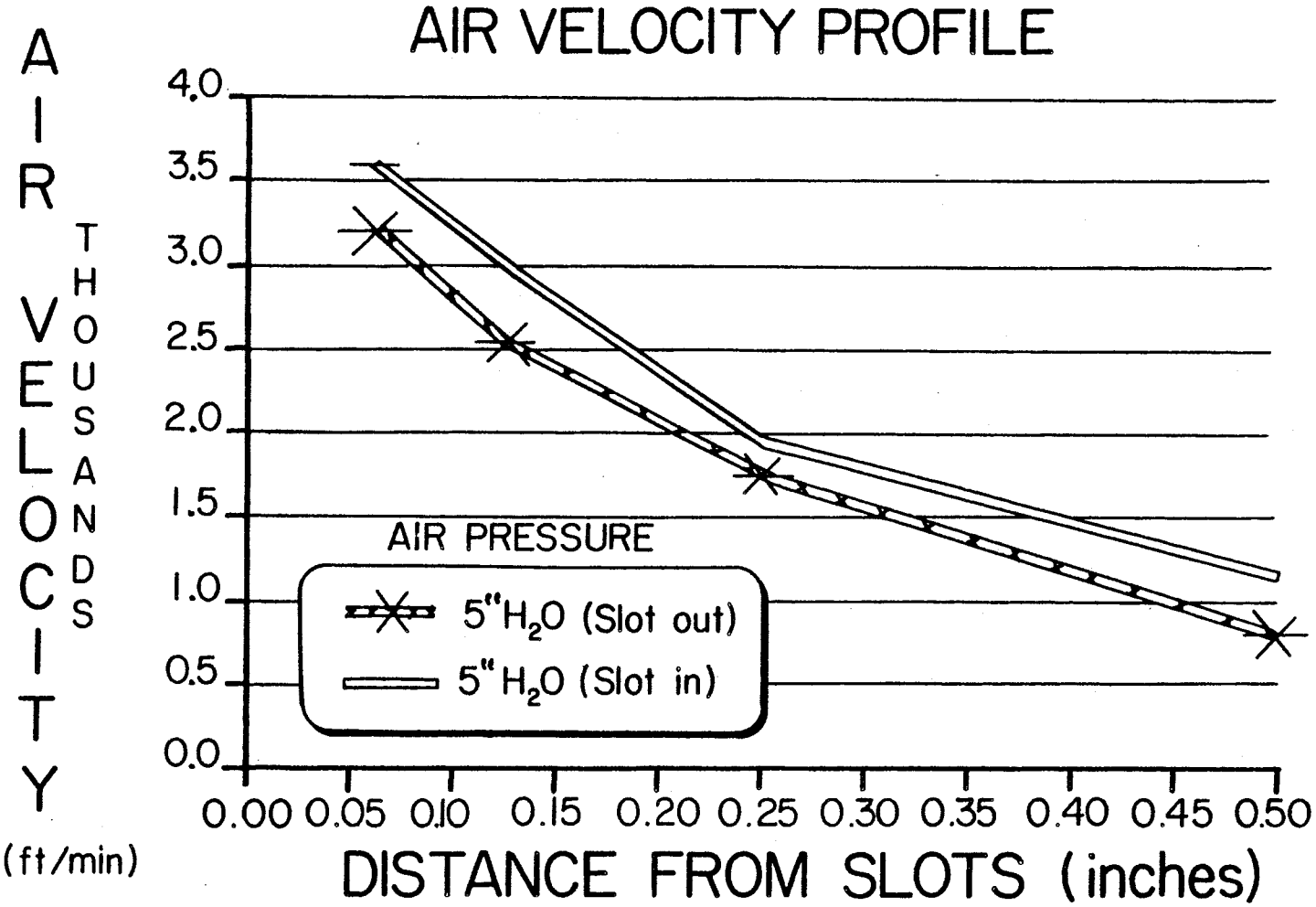
FIGS. 6 and 7 are velocity profiles at 5" and 10" $H_2O$ water gage air pressure for the directed fiber lay apparatus at varying distances from the card scrambler.
Figure 7:
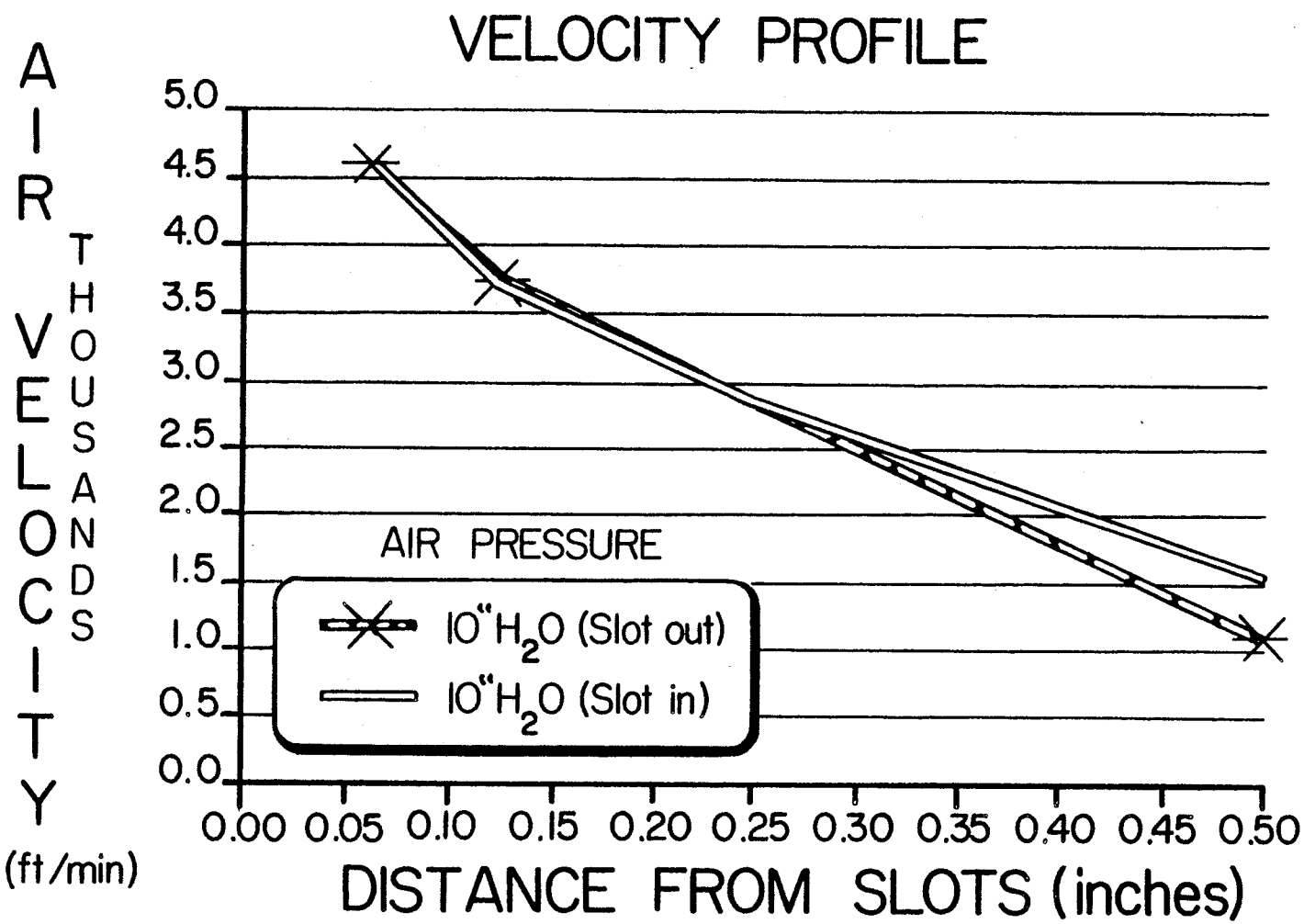

In FIG. 4, another version of the manifold 20 is shown having the louvers 24 pressed inwardly from the bottom wall 25. A comparison of the versions of FIG. 3 ("Slot Out") and FIG. 4 ("Slot In") is shown in FIG. 6, for an air pressure of 5 inches water gauge (water gauge of 28 inches equal to about 1 psi), and in FIG. 7, for an air pressure of 10 inches water gauge. The comparison shows that the "Slot In" version provides a slightly greater velocity of cross air flow for a given pressure and distance from the manifold. The velocity profile of the air flow for pressure of 10 inches water gauge was about 2500 ft/min. at a distance of 0.3 inch from the manifold, which is the distance to the top of the fibers in the examples given below.

Figure 5A:
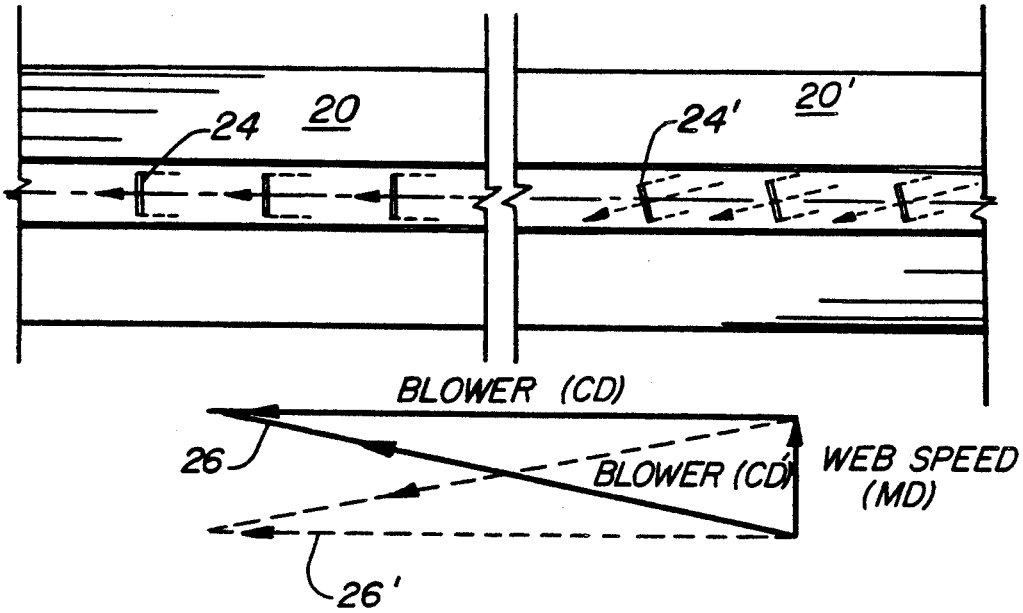
FIG. 5A shows a comparison of a version of the manifold having louvers oriented at an upstream angle to the web direction to one having louvers parallel to the web direction, and a diagram of the resulting apparent air velocities.
Figure 5B:
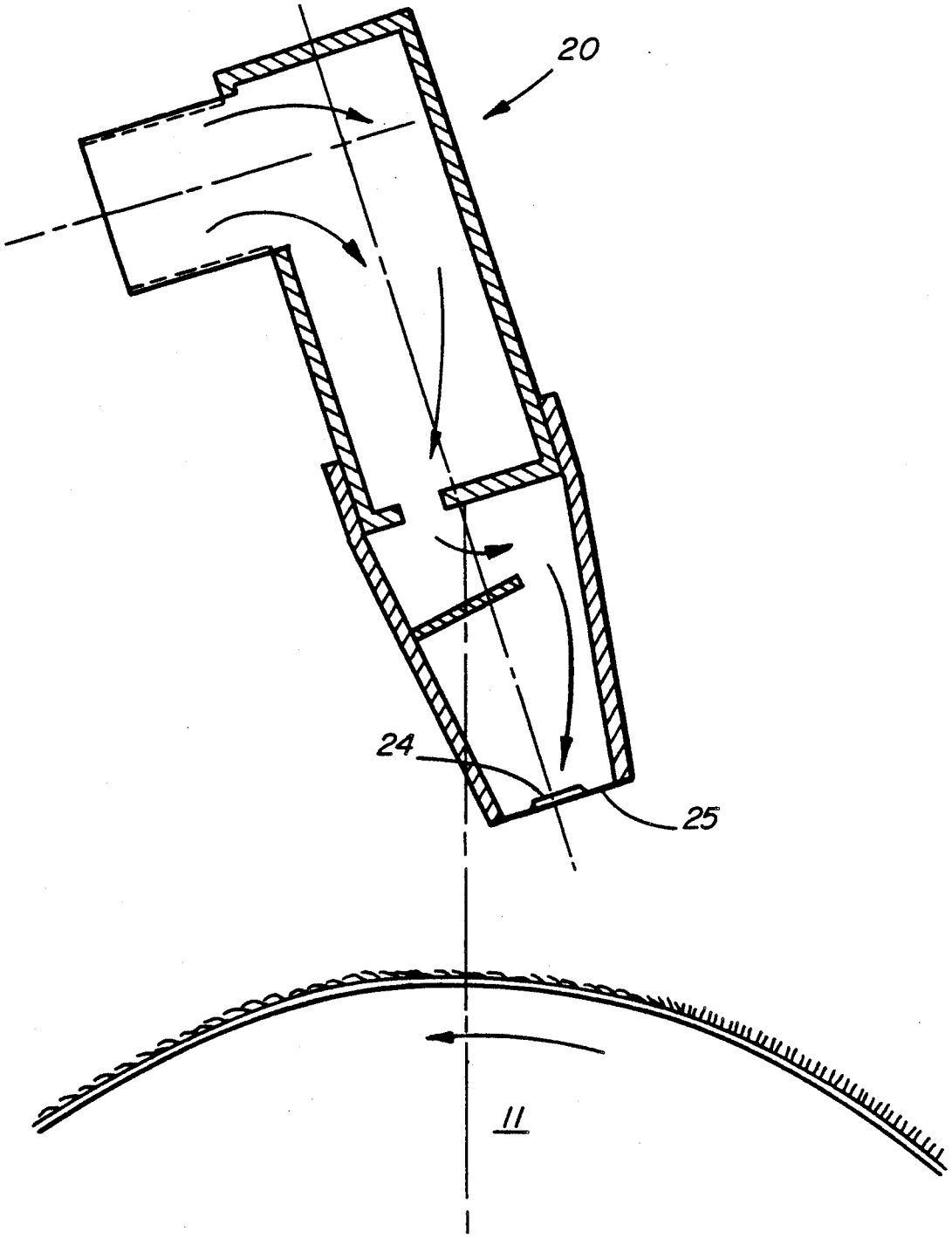
FIG. 5B is a side sectional view of a further version of the air blower manifold having its bottom end facing at an upstream angle to the circumference of the scramble roll.

In FIG. 5A, a further version shown on the right side of the drawing has the louver elements 24' oriented at an upstream angle, preferably about 20 degrees to the cross direction, as compared to the version shown on the left side of the drawing having the louver elements 24 oriented at zero degrees (parallel) to the cross direction. The vector diagram shows the apparent air velocity 26' of the right-hand version to be parallel to the cross direction, as compared to the apparent air velocity 26 of the left-hand version, taking into account the web speed in the machine direction. In FIG. 5B, yet another version of the manifold 20 has the bottom end facing at an upstream angle to the web in the machine direction on the scrambler roll 11. The orientation of the louvers at an upstream angle toward the we tends to push the fibers onto the wire of the scrambler roll 11 and prevent them from being lifted off by the cross flow of air.

Development trials were carried out using manifolds spaced 0.5 inch above the scrambler roll, with louvers of 0.01 by 0.3 inch dimensions, spaced at 0.5 inch intervals at zero angle. The web consisted of crimped polypropylene fibers of 2.2 denier and 1.5 inch staple lengths. The web speed was 375 ft/min. The doffer-to-scrambler speed ratio was 1.7:1.0 in trials 1 and 2, and 1.55:1.0 in trial 3. The tensile strength in grams/inch, toughness in inch-grams/inch$^2$, and percent elongation of the resulting thermal bond fabric were measured in the cross direction (CD) and machine direction (MD). Table I summarizes the results obtained for the trials as compared to a control example in which no cross flow realignment was employed and the fibers were slightly randomized by the scrambler roll. The results showed an increase of 30% to 50% in CD tensile strength without a significant decrease in MD tensile strength. Webs realigned at lower speeds of about 100 ft/min. were also found to have comparable increases in CD tensile strength with little or no loss in MD tensile strength.

TABLE I

| Example | Manifold Pressure (inch WG) | Strip Tens. Str CD | Strip Tens. Str MD | Toughness CD | Toughness MD | Elong. % CD | Elong. % MD |
|---|---|---|---|---|---|---|---|
| 1. | 10 | 428 | | 279 | | 113 | |
| Control | — | 335–355 | | 240–262 | | 122–129 | |
| 2. | 7 | 441 | 1613 | 292 | 686 | 116 | 66 |
| | 4 | 381 | 1610 | 251 | 640 | 115 | 62 |
| Control | — | 338 | 1572 | 248 | 651 | 121 | 64 |
| 3. | 7 | 404 | 1479 | 246 | 552 | 106 | 59 |
| | 4 | 385 | 1528 | 239 | 628 | 106 | 63 |
| Control | — | 353 | 1574 | 248 | 560 | 107 | 60 |

The carded web of realigned fibers may be used to made nonwoven fabrics which are thermally bonded, such as by calendaring, hot air, or sonic bonding, chemically bonded, or mechanically bonded, such as by hydroentangling, needle punching, or stitch bonding. The directed fiber lay manifold was tested on full-width production equipment for thermal bond fabric (21%–27% bond area) for diaper topsheets. The manifold was spaced 0.5 inch above the scrambler roll, with louvers of 0.01" by 0.3" inch dimensions, spaced at 0.5 inch intervals at zero angle and air pressure at 10 inches water gauge. The process speeds were 375 ft/min. in Trial 4, and 150 ft/min. in Trial 5. The results are summarized on Table II, showing a CD strip tensile strength increase of 30% to 50% together with significant increases in MD tensile strength and toughness.

TABLE II

| Example | Weight (gsy) | Tens. Strength CD | Tens. Strength MD | Toughness CD | Toughness MD | Elong. CD | Elong. MD |
|---|---|---|---|---|---|---|---|
| 4. | 19.2 | 406 | 1753 | 278 | 795 | 119 | 69 |
| Control | 19.2 | 328 | 1546 | 230 | 585 | 124 | 61 |
| 5. | 18.6 | 635 | 2088 | 294 | 953 | 81 | 69 |
| Control | 18.1 | 409 | 1943 | 101 | 612 | 61 | 54 |

The fiber realignment technique may also be used for a web that is hydroentangled. In a further example, carded web having a weight of 10 gm./sq.yd., consisting of a blend of 50% 1.5 denier rayon fibers and 50% 1.5 denier polyester fiber with staple lengths of 1.6 inch, were passed under an air blower manifold spaced 0.5 inch above the scrambler roll, having louvers of 0.01"×0.3" inch dimensions spaced at 0.5 inch intervals and angled at 20 degrees to the cross direction. The air pressure of the manifold was 10 inches water gauge. The speed ratio of doffer-to-scrambler roll was 2:1. Four layers of realigned carded web were deposited on a mesh screen having 24% open area and hydroentangled on one side using jets of water from three manifolds at pressures of 600, 1000, and 1200 psi, respectively. The partially entangled web was then transferred to another mesh screen and passed under four additional manifolds using jets of water at pressures of 1000, 1400, 1600 and 1600 psi, respectively. The hydroentangled web was then dried conventionally using steam cans and wound on a roll. A comparison of the resulting fabric (41 gm./sq.yd.) to a control fabric in which the carded webs were not subjected to cross air flow realignment showed greater than a 50% increase of CD grab tensile strength, from 5.3 to 8.0 g/in., without a decrease in MD tensile strength.

Figure 8A:
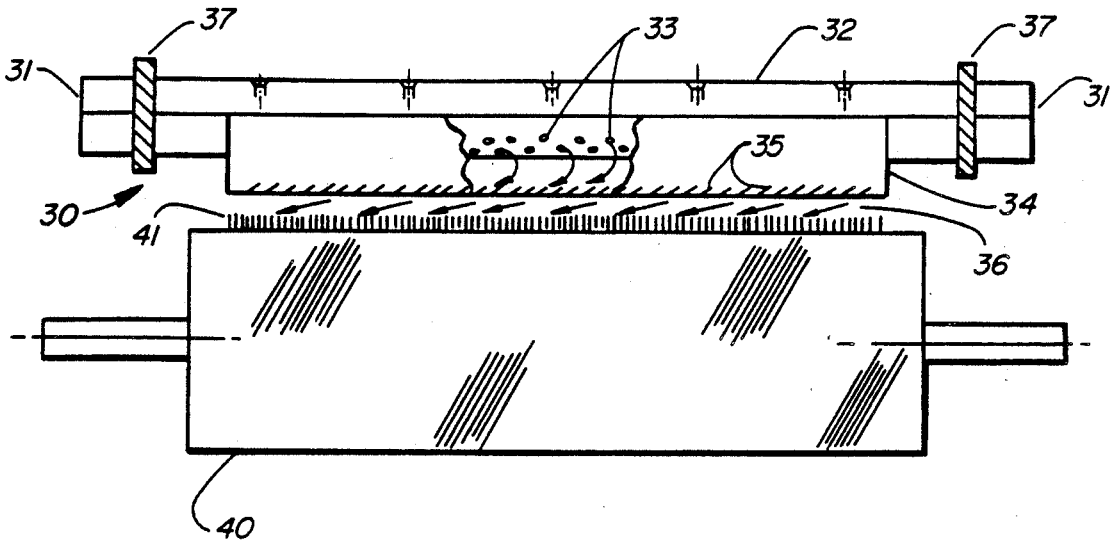
FIG. 8A is a front view and FIG. 8B is an enlarged side sectional view of another version of the air blower manifold.
Figure 8B:
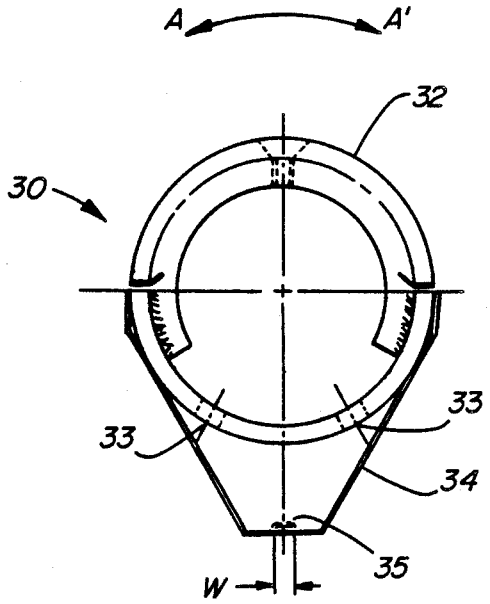

FIGS. 8A and 8B show another version of the directed air blower manifold 30, having air inlet ports 31, a primary plenum chamber 32 with air dispersal holes 33, and a secondary plenum chamber 34 with vanes or louvers 35, for directing the air flow in the cross direction, as indicated by numeral 36, across the ends of the erect fibers 41 held on the scrambler roll 40. The air inlet ports 31 are at each end of a circular cross-sec&:ion tube forming the primary plenum 32 of the manifold. The air passes from the primary plenum into the secondary plenum through the air dispersal holes 33 spaced along the length of the primary plenum tube. The holes act as modulators to even out the air pressure between the primary and secondary plenum chambers. A quick release system including clamps enables the manifold to be assembled and removed from the card easily.

The air from the secondary plenum 34 is directed across the carded web via the multiple unidirectional louvers 35 which are spaced, for example, at 0.5 inch intervals, along the length of the secondary plenum 34. The secondary plenum 34 may be formed in a trough-shape from a sheet of stainless steel which clips around the lower section of the circular tube of the primary plenum 32. Returns along the inner edges of the secondary plenum sit along the inside of the manifold, preventing air pressure in the secondary plenum from deflecting the sheet metal outward. The louvers 35 having a selected width W may be punched along the length of the bottom wall of the stainless steel sheet. Using the quick release system, the manifold may be pivoted through a range of angles A—A' relative to the scrambler roll 40.

The advantages of the above manifold structure are as follows. Protruding hardware is eliminated so that the manifold has a smooth profile. For example, the secondary plenum is held in place to the primary plenum without the need for protruding fasteners. The manifold is fed with air from the ends, thereby eliminating the need for feed hoses which might become an obstruction. The circular cross section of the primary plenum tube facilitates easy mounting, adjustment, or removal using the quick release system. The tubular design enables the unit to be pivoted easily so that the air from the louvers can be directed at any angle of attack relative to the scrambler. Also, the tubular shape of the manifold allows it to slide in the loosened clamps to adjust the position of the manifold in the cross direction. The limited number of fasteners also allows the unit to be easily disassembled for cleaning.

A substantial increase in CD tensile strength is obtained by using the manifold to direct a flow of air across the fibers in the cross direction. The manifold is compact and relatively simple in construction without any moving parts, and is inexpensive to produce. It can be retrofitted to existing carding lines and can be readily adapted to any width of web. The simplicity and low cost of the manifold provide advantages over the complex air randomizing or mechanical brushing systems of the prior art.

Other designs of the air blower manifold, air pressures, manifold spacing, louver sizes and spacings, web speeds, and doffer-to-scrambler roll speed ratios may of course be used, given the principles of the invention described herein. Different types of fabric products can be formed using the realigned carded webs of the invention. For example, different layers of carded webs having fibers blown in different directions can be combined to form high tensile strength fabrics. All such variations and further uses are nevertheless considered to be within the spirit and scope of the invention, as defined in the following claims.

We claim:

1. A method for reorienting fibers in a carded nonwoven web of staple fibers, the web including machine and cross directions respectively corresponding to longitudinal and transverse web axes, comprising the steps of:

(a) supporting the fibers on a surface of a rotatable support cylinder such that the ends of said fibers are predominantly substantially radially outwardly oriented; and (b) impacting the radially outwardly oriented portions of said fibers while supported on said rotatable cylinder with a uniform air flow which is not parallel to said machine direction to effect reorientation of said radially outwardly oriented portions of said fibers predominantly in the cross direction, said air flow having sufficient energy to reorient the fibers without displacing the fibers on the support cylinder.

2. The method of claim 1, wherein the web is advanced on the process line at a substantially constant velocity.

3. The method of claim 1, wherein the support member is a wired roll and the web is advanced at a substantially constant velocity relative to the air flow.

4. The method of claim 3, wherein the air flow is a cross directional air flow having a velocity of about 2500 feet/min. at the radially oriented portions of the fibers.

5. The method of claim 3, wherein the web velocity is about 375 feet/minute.

6. A nonwoven web of fibers produced by a method comprising the steps of:

(a) supporting the fibers on a surface of a rotatable support cylinder such that the ends of said fibers are predominantly substantially radially outwardly oriented; and (b) impacting the radially outwardly oriented portions of said fibers while supported on said rotatable cylinder with a uniform air flow which is not parallel to said machine direction to effect reorientation of said radially outwardly oriented portions of said fibers predominantly in the cross direction, said air flow having sufficient energy to reorient the fibers without displacing the fibers on the support cylinder, wherein said web has a cross directional tensile strength 30% or more greater than a web of the same composition in which the fibers have not been reoriented by said cross-directional air flow.

7. The nonwoven web of claim 6, comprising staple polypropylene fibers wherein the web is used to form a thermal bond fabric of approximately 18 grams/square yard, having a strip tensile strength of 406 grams/inch or more in the cross direction.

8. The nonwoven web of claim 6, comprising a mixture of staple polyester and rayon fibers, wherein the web is used to form a hydroentangled fabric having a weight of approximately 41 grams/square yard, and a grab tensile strength of about 8.0 lbs/inch in the cross direction.

9. An apparatus for use in-line with a carding line to reorient fibers in a carded nonwoven web of staple fibers, the carding line including an output end, the web having a machine direction and a width in a cross direction corresponding to longitudinal and transverse web axes, respectively, comprising:

(a) a rotatable support cylinder for receiving fibers from said output end of said carding line and supporting said fibers on a surface thereof such that the ends of said fibers are predominantly substantially radially outwardly oriented;

(b) a manifold disposed at the output end of the carding line in overlying relation across the width of the supporting surface of said rotatable support cylinder, said manifold comprising control means for providing an evenly distributed air flow, and output means for uniformly directing said air flow across said radially outwardly oriented ends of said fibers in a direction which is not parallel to said machine direction, thereby reorienting said radially outwardly oriented ends of said fibers predominantly in the cross-direction.

10. An apparatus according to claim 9, wherein said manifold is spaced relative to said surface of said rotatable support cylinder such that said air flow has sufficient energy to reorient the fibers without displacing the fibers on the support cylinder.

11. An apparatus according to claim 10, wherein said output means includes a generally planar panel on a bottom end of said manifold having a plurality of spaced louvers arranged in a row in the cross-direction.

12. An apparatus according to claim 11, wherein said louvers have dimensions of approximately 0.01"×0.3" wide, and have a center-to-center spacing of approximately one half inch.

13. An apparatus according to claim 11, wherein said bottom end of said manifold is spaced about 0.5 inch above said support member.

14. An apparatus according to claim 9, wherein said control means includes a plenum chamber which communicates with said output means, said plenum chamber including a wall having a plurality of spaced openings and a baffle disposed between said wall and the output means.

15. An apparatus according to claim 14, wherein said output means includes a generally planar panel having a plurality of spaced louvers arranged in the cross-direction, said louvers having dimensions of approximately 0.01"×0.3" wide with a center-to-center spacing of approximately one half inch.

16. An apparatus according to claim 15, wherein said wall includes a plurality of uniformly spaced openings each having a diameter of approximately ⅜ inch and a center-to-center spacing of approximately 1 inch.

17. An apparatus according to claim 11, wherein said louvers are oriented at an upstream angle of about 20° to the cross direction.

18. An apparatus according to claim 9, wherein said output means is oriented at an upstream angle to the web in the machine direction.

19. An apparatus according to claim 10, wherein said control means of said manifold is a primary plenum in the shape of a tube having a length extending along its tube axis, air inlet ports at its opposite ends, and air dispersal holes spaced along its length in the cross direction, and said output means is a trough-shaped secondary plenum elongated in the cross-direction having an open upper section which is fastened onto a lower section of said primary plenum.

20. An apparatus according to claim 10, wherein said manifold is mounted by a release system which includes a pair of clamps for clamping onto the opposite ends of said primary plenum tube, said clamps being releasable so as to allow said manifold to be pivoted about the tube axis to adjust the angle of attack of said air flow relative to said surface of said support cylinder and to be adjusted in position along the tube axis in the cross-direction.

* * * * *